United States Patent [19]

Sterns

[11] Patent Number: 4,460,877

[45] Date of Patent: Jul. 17, 1984

[54] BROAD-BAND PRINTED-CIRCUIT BALUN EMPLOYING COUPLED-STRIP ALL PASS FILTERS

[75] Inventor: William G. Sterns, Canoga Park, Calif.

[73] Assignee: International Telephone and Telegraph Corporation, New York, N.Y.

[21] Appl. No.: 443,419

[22] Filed: Nov. 22, 1982

[51] Int. Cl.[3] ..... H01P 5/10

[52] U.S. Cl. ..... 333/26; 333/204

[58] Field of Search ..... 333/26, 21 R, 33, 204

[56] References Cited

U.S. PATENT DOCUMENTS 2,484,028 10/1949 Hansen ..... 333/26

OTHER PUBLICATIONS

Jones, E. M. T. and Shimizu, J. K., "A Wide-Band Stripline Balun", *IRE Transaction on Microwave Theory and Techniques*, vol. MTT-7, pp. 128-134; Jan. 1959.

Jones, E. M. T. and Bolljahn, J. T., "Coupled-Strip--Transmission-Line Filters and Directional Couplers", IRE Transaction on Microwave Theory and Techniques, vol. MTT-4, pp. 77-81, Apr. 1956.

*Primary Examiner*—Paul L. Gensler
*Assistant Examiner*—Benny Lee
*Attorney, Agent, or Firm*—T. E. Kristofferson; A. D. Stolzy

[57] ABSTRACT

A TEM mode balun in a single-level microwave circuit in a transmission line medium selected from among the stripline, microstrip, airstrip, etc. media. The device employs coupled-strip all-pass filter elements to provide a pair of balanced input/output lines in 180° phase relationship and an unbalanced line port.

3 Claims, 5 Drawing Figures

FIG. 1
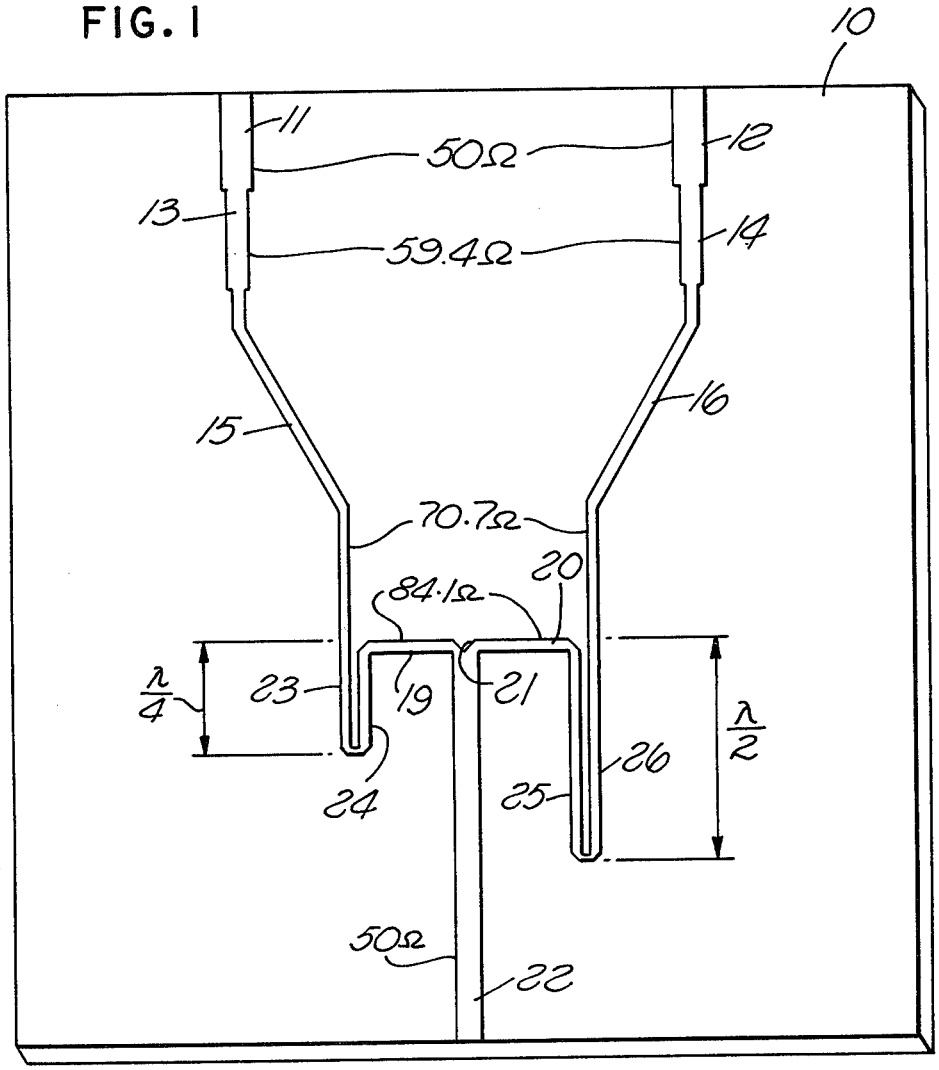
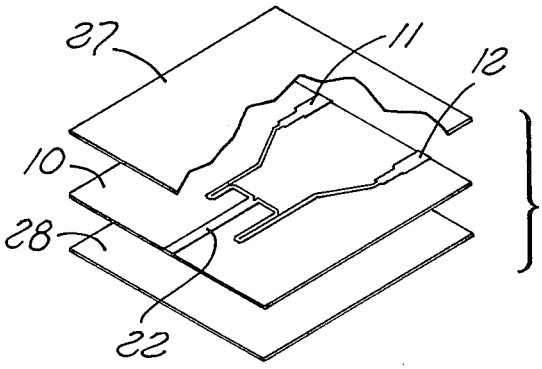
FIG. 2

FIG. 3 TYPICAL BALUN PERFORMANCE

BROAD-BAND PRINTED-CIRCUIT BALUN EMPLOYING COUPLED-STRIP ALL PASS FILTERS

BACKGROUND OF THE INVENTION

1. Field of the Invention

The invention releates to a microwave balun, generally, and more particularly to such baluns as may be integrally constructed in antenna and transmission line systems in stripline, microstrip and similar media.

2. Description of the Prior Art

The so-called balun (the name compounded from the words balanced and unbalanced) is of itself a well known device employed in radio frequency circuits to effect a transition between balanced lines such as two wire open air transmission lines, for example, to an unbalanced line, it is inferred that the instantaneous phase relationship between the two lines is 180° or close thereto. The phase relationship between either of these balance lines and the unbalanced feed is usually of no consequence however. A balun instrumented in any of the available transmission line media is inherently a reciprocal device.

The text *An Antenna Engineering Handbook,* Henry Jasik, editor, McGraw-Hill 1961 (First Edition), describes the balun in basic terms at section 31.6 of that text. From this description it will be understood, and is otherwise well known of course, that a balun can also operate as an impedance transformer for matching the characteristic impedance of a balance line to an unbalanced line, these often differing substantially.

From the aforementioned text, and FIGS. 31–24 thereof, it will be realized that a balun may be instrumented in a number of known ways.

With the advent of low-cost transmission line techniques of the stripline, microstrip or similar types, a need arises for a compatible form of balun. Moreover, broadband performance is frequently required, that is, relatively uniform response over a band, possibly an octave or more.

The same "Antenna Engineering Handbook" also provides a background in strip transmission lines and design considerations therefor.

A basic element employed in the combination of the invention is described as an "all-pass filter" in the paper "Coupled-Strip-Transmission-Line Filters and Directional Couplers" by E. M. T. Jones and J. T. Bolljahn (*IRE Transactions on Microwave Theory and Techniques,* April 1956). In that paper, the basic design criteria for various coupled-strip configurations are given in physical dimension and impedance relationships. The so-called "all-pass" filter included in the Jones and Bolljahn description will be recognized as an inherently broadband device.

In a technical paper by B. M. Schiffman (*Transactions on Microwave Theory and Techniques*—IEEE April 1958), an application of the coupled strip elements to produce a 90° phase shifter is described.

The manner in which the invention provides an inexpensive, broadband and otherwise effective balun in strip type media will be understood as this description proceeds.

SUMMARY

With reference to the state of the prior art, it may be said to have been the general objective of the invention to provide a broadband, low-loss, inexpensive form of microwave circuit balun in strip transmission line type medium or related media such as the so-called microstrip, etc. In a typical embodiment, in stripline, a pattern of printed circuit conductors on a dielectric substrate is mounted, generally symmetrically, between a pair of ground planes. The unbalanced line (input or output, since the device is reciprocal) comprises a single trace dimensioned according to well known criteria to effect a desired line impedance. This unbalanced line is split into two paths, each of which includes a coupled-strip-transmission line filter of the all-pass type. The aforementioned two paths are subsequently flared apart to provide the desired parallel traces constituting the balanced line (input or output), appropriate impedance transitions being provided by correspondingly sized traces in these paths.

The unbalanced line is branched laterally in traces of equal lengths connecting discretely into these coupled-strip sections. One of those coupled-strip sections is a ¼ wavelength section, the other being of a ½ wavelength.

Although the phase relationship between the unbalanced line and either of the balanced lines will be seen to vary as a function of frequency, the phase relationship between the the two balanced lines remains at 180° within a very close tolerance.

A detailed description of a preferred embodiment according to the invention will be described as this specification proceeds.

BRIEF DESCRIPTION OF THE DRAWINGS

FIG. 1 is a plan view of a section of dielectric substrate on which the printed conductive circuit traces implementing the invention are shown in place.

FIG. 2 is a partially cutaway perspective illustrating the article of FIG. 1 between two conductive ground planes thereby forming a balun in stripline medium.

DETAILED DESCRIPTION

Figure 3:
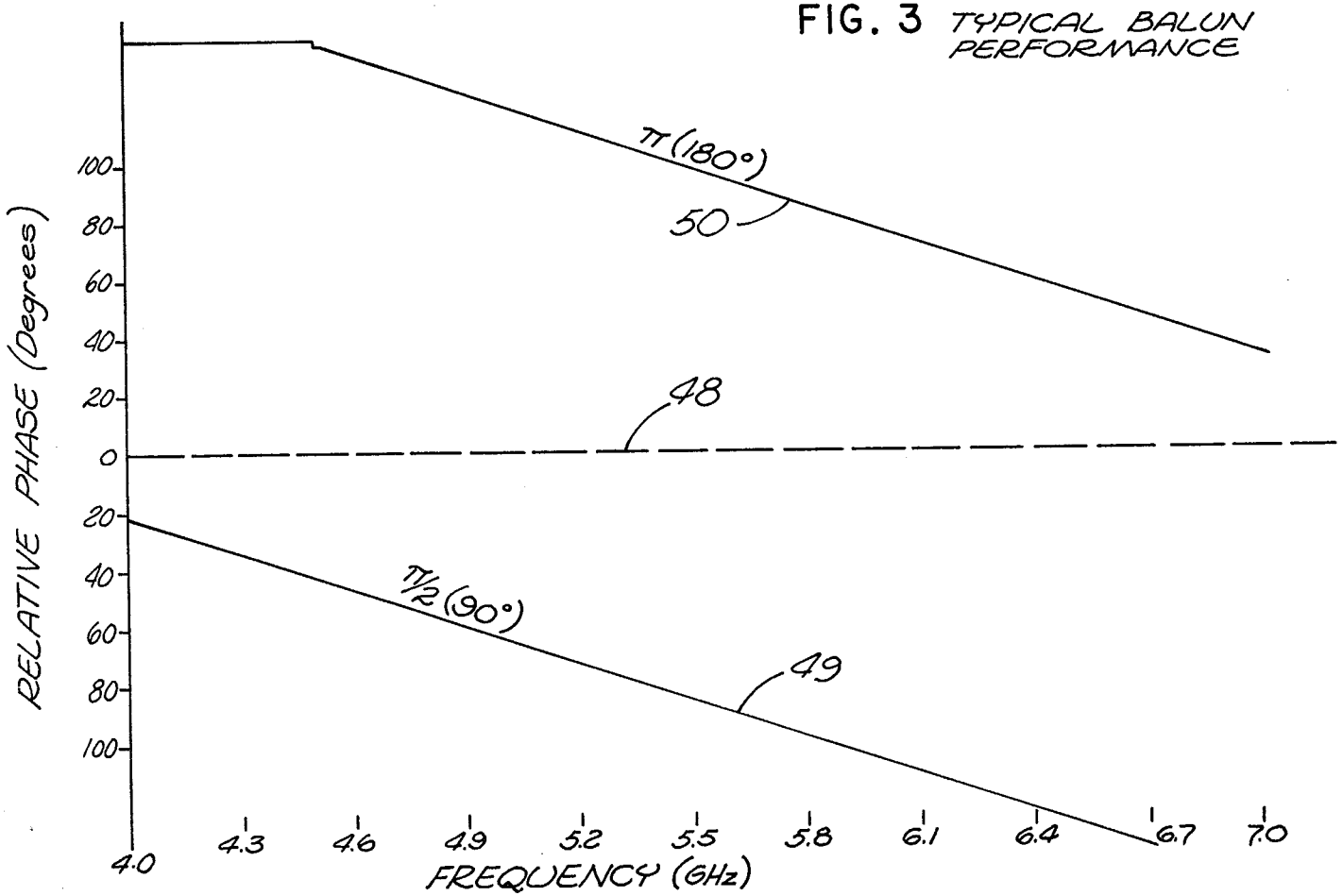
FIG. 3 is a graph illustrating the relative phase performance of a balun according to the invention, as a function of frequency.

Referring now to FIG. 1, the printed circuit traces comprising the balun of the invention are shown applied to a dielectric substrate 10. The trace 22 comprises the unbalanced input/output which branches into 19 and 20. The traces 23 and 24 constitute a ¼ wave coupled-strip all-pass filter section, conductive traces 23 and 24 being connected (shorted) at their downward pointing ends (i.e., downward in the context of the illustration of FIG. 1).

The branch 20 is connected as shown to the ½ wave long coupled-strip pair comprising strips 25 and 26 bridged together at their downward pointing ends as was the case with 23 and 24.

The upwardly-extending continuations of traces 23 and 26, respectively, are illustrated at 17 and 18, these flaring outward into 15 and 16, respectively. This outward flare serves the purpose of positioning and spacing the balanced input/output traces 11 and 12 in accordance with the design impedance to be achieved. Traces 13 and 14 will be seen to be slightly wider than traces 15 and 16, this providing a step impedance transformation from the higher values at 15 and 16 into the lower impedance values represented by the wider traces 11 and 12. Following in tabular form is a listing of the design impedances of the various traces of FIG. 1 assuming that it was desired to match an unbalanced input/output at 22 of 50 ohms to a balanced 50 ohm line represented by 11 and 12.

| Trace | Design Impedance (Ohms) |
|---|---|
| 22 | 50.0 |
| 19, 20 | 84.1 |
| 15, 16, 17, 18 | 70.7 |
| 13, 14 | 59.4 |
| 11, 12 | 50.0 |

The transition point is provided with a generally "V-shaped" notch 21 (empirically shaped and dimensioned) in order that the individual trace widths from the effective center of this split remain relatively constant passing into traces 19 and 20.

Referring now to FIG. 2, the circuit traces and substrate of FIG. 1 are shown as they would be between two ground planes 27 and 28 in an implementation of the invention in stripline medium. The partial cutaway of the conductive ground plane 27 has been made for a clearer view of the FIG. 1 configuration within these ground planes.

Reverting to FIG. 1, it should be emphasized at this point that the Jones and Bolljahn technical paper hereinbefore identified provides extensive mathematical analysis and design information relating the various parameters including the degree of coupling between the closely parallel legs of the coupled-strips, i.e., 23 coupled to 24 and 25 coupled to 26. While the prior art, including the recognized works of prior contributors mentioned in the Jones and Bolljahn technical paper, make it possible to approach the determination of degree of coupling within the coupled strips somewhat rigorously, it is also pointed out that the coupling (spacing of the paralled coupled traces) can be empirically determined. It is desirable to have a relatively high degree of such coupling. Typically, the spacing between the parallel traces of each of the coupled-strip sections (all-pass filters) of FIG. 1 is a small fraction of the strip width. For example, in a typical implementation in which the strip widths in these all-pass filter sections were on the order of 3/64ths of an inch, the spacing laterally was a uniform amount less than 1/64th of an inch. For significant levels of radio frequency power handling capability, the coupling may be limited by voltage breakdown considerations.

The equations for image impedance ($Z_I$) in terms of the even and odd mode characteristic impedances of the lines ($Z_e$ and $Z_o$, respectively) and the coupled section electrical length ($\theta$) are as follows:

$$Z_I = \sqrt{Z_{oo}Z_{oe}}$$

$$\text{Cos}\phi = \frac{\frac{Z_{oe}}{Z_{oo}} - \tan^2\theta}{\frac{Z_{oe}}{Z_{oo}} + \tan^2\theta}$$

For a section 90° long, the insertion phase is 180°; and for a section of 180° length, the insertion phase is 360°. Accordingly, the two sections shown in the configuration of FIG. 1 will provide a 180° phase relationship between the balanced line terminals (11 and 12 of FIGS. 1 and 2) at the design center frequency and also at two additional (outboard) frequencies symmetrically spaced about the center frequency. These outboard frequency point spacings from the said center frequency are controlled by the ratio of even-to-odd mode impedances of the all-pass filter sections.

If the ratio $$\frac{Z_{oe}}{Z_{oo}} = \rho,$$

and if $\rho$ is the same for both insertion phase networks (coupled-strip sections), then the effects of manufacturing tolerances, substrate dielectric constant variations and ground plane spacing variations are minimized.

Figure 5:
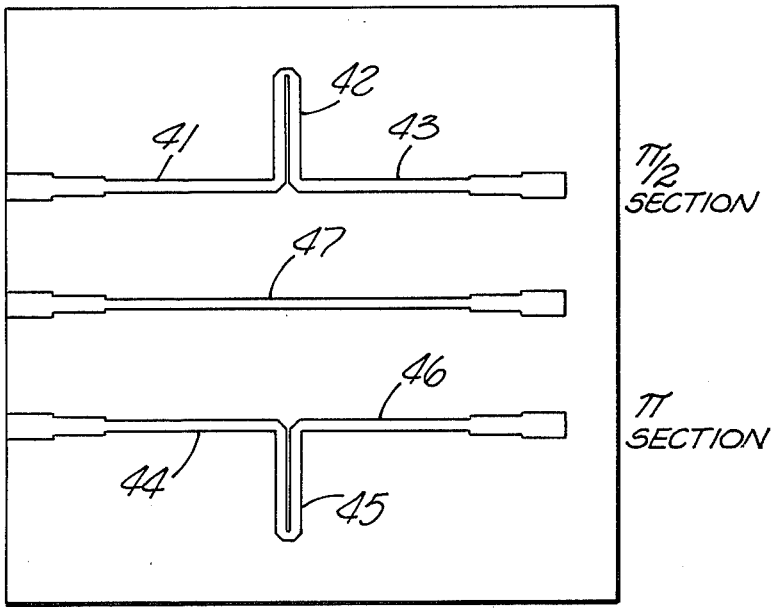
FIG. 5 is a test circuit layout for determining the phase performance of coupled-strip sections as a function of frequency.

In a test set-up to prove the theory of the invention, a microwave grade substrate having a rated dielectric constant of 2.5 was employed and traces were installed thereon as indicated on FIG. 5.

Looking ahead to FIG. 5, the performance of the all-pass filter sections employed (in the form of coupled-strip-transmission line shorted sections) to effect particular phase shift performance as required by the balun of the present invention will be explained. FIG. 5 is actually a balun test circuit in which a straight strip 47 is provided as a reference line for measurement of phase shift. The other paths include the $\pi/2$ and $\pi$ ($\frac{1}{4}$ wave and $\frac{1}{2}$ wave) sections, the former in series with strips 41 and 43 on either side of the $\frac{1}{4}$ wave section 42 and the $\frac{1}{2}$ wave section 45 between straight line sections 44 and 46.

Phase shift of line 47 is directly proportional to frequency $$\phi(\text{degrees}) = \frac{lf}{c} \times 360°$$

l=length
f=frequency
c=velocity of light

On FIG. 3, the straight line 48 represents the output of a non-dispersive phase bridge when the test, or reference, line 47 is inserted in the bridge. The lines 49 and 50 on FIG. 3 are plots of the phase of signal emerging from 43 and 46, at the right hand of FIG. 5, assuming excitation at the left hand of the FIG. 5 traces relative to the phase of straight line 48. It will be seen that the relative phase between the outputs of traces 43 and 46 is a relatively constant 180° phase relationship. In an actual test set-up according to FIG. 5, the 180° phase differential between curves 49 and 50 tracked an optimum 180° value within 1% over a 33% bandwidth. This relationship can be applied directly to the phase relationship at balun terminals 11 and 12 in FIGS. 1 and 2. Thus, a balun according to the configuration of FIGS. 1 and 2 can be implemented with at least 33% bandwidth. One practical implementation according to FIG. 1 maintained the phase difference between balance line terminals at 172°±1° from 4.3 to 6.7 GHz, a 43% band. Empirical adjustment of the lengths of the coupled-strip sections can be undertaken to adjust this phase difference quite accurately at 180° at the center of frequency and at the two outboard frequencies previously identified.

The impedance bandwidth of the balun according to FIG. 1 is limited only by the bandwidth of the impedance transformers, which can be made almost arbitrarily wide, since the image impedance of the all-pass filter sections is independent of frequency.

Figure 4:
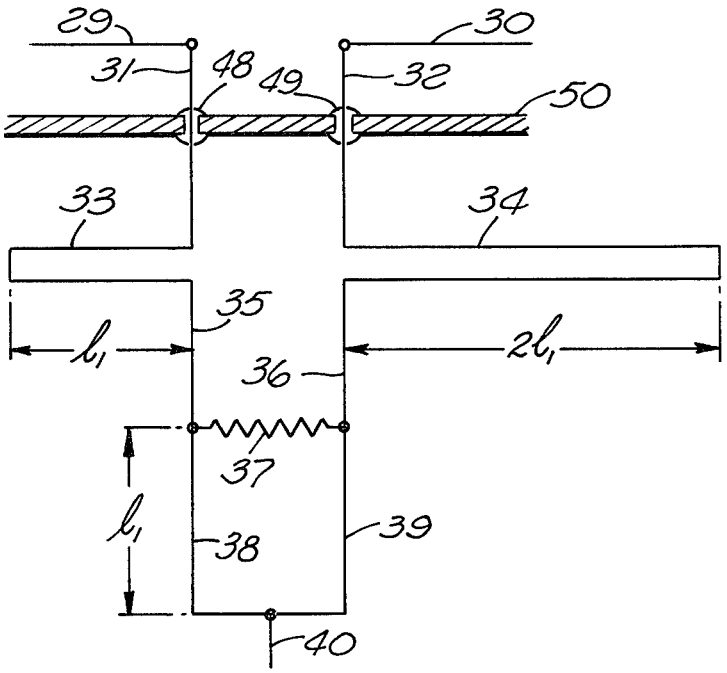
FIG. 4 is an embodiment of the balun of the invention combined with a Wilkinson power divider/combiner.

Referring now to FIG. 4, an adaptation of the balun invention is illustrated. A dipole antenna comprising 29 and 30 is mounted in fixed relationship to a conductive surface (reflector or the like), the conductive surface 50 being shown on edge. Balanced feed lines 31 and 32 passing through the conductive surface 50 at feed-through points 48 and 49, respectively, connect as indicated discretely to coupled-strip-transmission line sections 33 and 34. Although these coupled-strip sections extend laterally, they are electrically the equivalent of the configuration of FIG. 1. Lines 35 and 36 are the equivalent of 19 and 20 in FIG. 1. From there on down as viewed in FIG. 4, the termination resistor 37 and conductive traces 38 and 39 leading to an unbalanced port 40 constitute a Wilkinson type, power divider combined with the balun of the invention. This configuration of FIG. 4 produces an isolated power divider/-balun combination operable over a wide frequency range. Such an isolated power divider has a common mode rejection characteristic making it independent of load impedance values. An unequal in-phase power divider could be substituted for the Wilkinson divider if indicated by the design requirements.

Other variations and adaptations of the invention will suggest themselves to those of skill in this art once the principles of the invention are fully appreciated. Accordingly, it is not intended that the drawings or this description should be regarded as limiting the scope of the invention.

What is claimed is:

1. A TEM mode microwave balun constructed in a medium selected from media including stripline, microstrip and airstrip, comprising:

a dielectric substrate;

a pattern of conductive traces along the surface of said substrate, said pattern including a trace corresponding to an unbalanced transmission line, a pair of branches extending in generally opposite directions along said surface of said substrate from the trace of said unbalanced line;

a first close-coupled-strip-transmission line filter comprising a first pair of close-coupled, generally parallel, conductive traces connected together at a first end thereof and being open at a second end, said first filter having a 360° insertion phase;

a second close-coupled-strip-transmission line filter comprising a second pair of close-coupled, generally parallel, conductive traces connected together at a first end thereof and being open at a second end, said second filter having a 180° insertion phase;

a spaced pair of generally parallel conductive traces along the surface of said substrate constituting a balanced transmission line, one trace of said spaced pair being connected to a trace of said first coupled-strip filter at said open end thereof and the other trace of said spaced pair being connected to a trace of said second coupled-strip filter at said open end thereof, each of the remaining traces of said coupled-strip filters being connected to a corresponding one of said branches.

2. The balun of claim 1 in which said generally parallel pattern of conductive traces includes impedance transitions in the form of progressive changes in trace width along said traces of said spaced pair.

3. A balun according to claim 1 in which first and second conductive ground planes are provided parallel to and spaced from said substrate, one such ground plane opposite each surface of said substrate.

* * * * *